US007465180B2

(12) United States Patent
Kusuda et al.

(10) Patent No.: US 7,465,180 B2
(45) Date of Patent: Dec. 16, 2008

(54) MODULAR PLUG AND PLUG INSTALLATION STRUCTURE

(75) Inventors: Kiyonori Kusuda, Kawasaki (JP); Hiroyuki Abe, Kawasaki (JP); Hiroshi Kadoya, Kawasaki (JP); Hisato Sato, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/585,903

(22) Filed: Oct. 25, 2006

(65) Prior Publication Data

US 2007/0298636 A1 Dec. 27, 2007

(30) Foreign Application Priority Data

Jun. 27, 2006 (JP) ..... 2006-177266

(51) Int. Cl.
*H01R 13/627* (2006.01)

(52) U.S. Cl. ..... 439/352; 439/344

(58) Field of Classification Search ..... 439/344, 439/352, 354

See application file for complete search history.

(56) References Cited

U.S. PATENT DOCUMENTS 5,462,457 A * 10/1995 Schroepfer et al. ..... 439/736
5,494,457 A * 2/1996 Kunz ..... 439/447
6,238,251 B1 * 5/2001 Curtis et al. ..... 439/680
6,250,949 B1 * 6/2001 Lin ..... 439/418
6,371,787 B1 * 4/2002 Branch et al. ..... 439/352
7,052,186 B1 * 5/2006 Bates ..... 385/59
7,063,554 B2 * 6/2006 Kuiken et al. ..... 439/352

FOREIGN PATENT DOCUMENTS

| | | |
|---|---|---|
| JP | 63-184271 | 7/1988 |
| JP | 63-184274 | 7/1988 |
| JP | 11-126653 | 5/1999 |

* cited by examiner

*Primary Examiner*—T C Patel
(74) *Attorney, Agent, or Firm*—Staas & Halsey LLP

(57) ABSTRACT

An modular plug includes a plug main body that can be inserted into and removed from a connector; an engaging claw configured to engage the plug main body with the connector; and an operations lever configured to turn off engagement of the plug main body and the connector by the engaging claw; wherein a lock turning-off member is provided at the plug main body so that the lock turning-off member can be slid in inserting and removing directions; an inclination surface of the lock turning-off member is formed in a position facing the operations lever; and the inclination surface operates the operation lever accompanying sliding in the inserting direction of the lock-turning off member so that the engagement of the engaging claw and the connector is turned off.

12 Claims, 12 Drawing Sheets

MODULAR PLUG AND PLUG INSTALLATION STRUCTURE

BACKGROUND OF THE INVENTION

1. Field of the Invention

The present invention generally relates to modular plugs and plug installation structures, and more specifically, to a modular plug having an operations lever for turning off a lock with a connecter when the modular plug is pulled out from the connector and a plug installation structure.

2. Description of the Related Art

Generally, when an electronic device is connected to another electronic device by a cable or the like, a connector and a plug are used. In this case, a cable plug is provided at a cable side and a connector where this cable plug is installed is provided at an electronic device side. Recently and continuously, it has been desired that size and thickness of the electronic device in which the connector is provided be made small and operability of the electronic device be improved. Therefore, cable plugs which correspond to such miniaturization and by which operability is attempted to be improved are suggested.

On the other hand, accompanying the recent spread of broadband, communication devices have been provided where a large amount of access side wirings (Ethernet signals or the like) is received and signals are multiplexed and concentrated so as to be sent to a transport side. In such a communication device, generally, an RJ-45 modular plug and connector are used. See Japanese Laid-Open Patent Application Publication No. 63-184271. An installation structure of a related art connector used for such a communication device is discussed with reference to FIG. 1 through FIG. 4.

FIG. 1 is a view showing a first related art modular plug (hereinafter "plug") 10A and FIG. 2 is a view showing a connector 1 where the plug 10A is inserted.

The plug 10A includes a plug main body 11, a lock claw 12, a lever part 14, and others. A cable 13 is connected to the plug main body 11. This cable 13 is electrically connected to a contact pin (not shown in FIG. 1) provided in the plug main body 11. Furthermore, the lock claw 12 prevents removal of the plug 10A from the connector 1 when the plug 10A is installed in the connector 1. The lock claw 12 is formed in a body with the lever part 14. The lever part 14 can be moved in directions indicated by arrows A1 and A2 in FIG. 1. The plug main body 11 and the lever part 14 are clamped by fingers and the lever part 14 is moved in the directions indicated by the arrow A2 so that the lock is turned off (disengaged).

FIG. 2 shows an example where two connectors 1 are stacked so that a large number of access side wirings are received.

Referring to FIG. 2, the connector 1 includes a first connectors gathering body 3 and a second connectors gathering body 4. The first connectors gathering body 3 is formed by eight connector parts 8 provided in a line in directions indicated by arrows X1 and X2. The second connectors gathering body 4 is formed by eight connector parts 8 provided in a line in directions indicated by arrows X1 and X2. The second connectors gathering body 4 is provided on the first connectors gathering body 3. The first connectors gathering body 3 and the second connectors gathering body 4 are resin sealed by molded resin 9.

Each of the connector parts 8 corresponds to an RJ-45 connector. Therefore, eight leads 6 and eight leads 7 are extended from surface sides of the connector parts 8. More specifically, the first leads 6 are extended from the connector parts 8 forming the first connectors gathering body 3 and the second leads 7 are extended from the connector parts 8 forming the second connectors gathering body 4.

The leads 6 and 7 are extended in horizontal directions at designated lengths and bent downward. Lower end parts of the bent leads 6 and 7 are connected by soldering to lands formed on a printed wiring board 2.

As discussed above, the connector part 8 corresponds to the RJ-45 connector. A plug having a lock claw is installed in the connector part 8. Therefore, in a case where plural connectors 1 are stacked, it is necessary to provide operations spaces for operating the lever parts 14 between the connectors 1.

FIG. 3 is a view showing a second related art plug. FIG. 4 is a view showing operations of the second related art plug. More specifically, FIG. 3 and FIG. 4 show a plug 10B disclosed in the above-mentioned Japanese Laid-Open Patent Application Publication No. 63-184271. In FIG. 3 and FIG. 4, parts that are the same as the parts of the plug 10A shown in FIG. 1 are given the same reference numerals, and explanation thereof is omitted. In the plug 10B, a pressed part 15 is formed at an end part of the lever part 14. A movable part 16 is provided to be movable along the plug main body 11.

When the plug 10B is removed from the connector 1, both side of the movable part 16 are clamped by fingers and the movable part 16 is moved in a removable direction, namely the left direction in FIG. 4. As a result of this, the movable part 16 comes in contact with the pressed part 15 and the pressed part 15 is forced downward, so that the lever part 14 is pressed downward. Hence, engagement with the connector 1 of the plug 10B by the lock claw 12 is turned off so that the plug 10B can be removed from the connector 1.

However, in the related art plug 10A shown in FIG. 1, in order to remove (pull out) the plug 10A from the connector 1, it is necessary to allow for operations of the lever part 14 as shown in FIG. 5. Here, FIG. 5 is a view showing a disadvantage of the first related art plug.

Therefore, as discussed above, it is necessary to provide the operations spaces for operation of the lever part 14 between a pair of the connectors 1 situated at upper and lower parts. Because of this, height of a space between the connector upper and lower parts (indicated by an arrow "h1" in FIG. 2) is great so that the thickness of the connector cannot be made small.

In addition, in the plug 10B shown in FIG. 4 and FIG. 5, although it is not necessary to clamp the plug main body 11 and the lever part 14 in upper and lower directions, it is necessary to clamp the movable part 16 from left and right directions in order to remove the plug 10B from the connector 1. Because of this, in the structure of the plug 10B, installation density of the connector parts 8 in the directions indicated by the arrows X1 and X2 in FIG. 2(A) is decreased. Hence, it is not possible to achieve miniaturization of the connectors.

SUMMARY OF THE INVENTION

Accordingly, the present invention may provide a novel and useful modular plug and plug installation structure solving one or more of the problems discussed above.

More specifically, the embodiments of the present invention may provide a modular plug and a plug installation structure whereby operability when the modular plug is removed from a connector is improved and the size and the thickness of the connector can be made small.

One aspect of the present invention may be to provide a modular plug, including: a plug main body that can be inserted into and removed from a connector; an engaging claw configured to engage the plug main body with the connector; and an operations lever configured to turn off engagement of the plug main body and the connector by the engaging claw; wherein a lock turning-off member is provided at the plug main body so that the lock turning-off member can be slid in inserting and removing directions; an inclination surface of the lock turning-off member is formed in a position facing the operations lever; and the inclination surface operates the operation lever accompanying sliding in the inserting direction of the lock-turning off member so that the engagement of the engaging claw and the connector is turned off.

The modular plug may further include an energizing member configured to exert a force on the lock turning-off member so that the inclination surface is separated from the operations lever. In the modular plug, a cylindrical shape member may be provided at the plug main body; a cable connected to the plug main body may be inserted inside of the cylindrical shape member; and a removing prevention part configured to prevent removal of the lock turning-off member from the plug main body may be provided at the plug main body. In the modular plug, the inclination surface may be formed inside of a projection of the plug main body; and the projection can be used as an operations knob for operating the lock turning-off member. In the modular plug, the lock turning-off member has an internal space where a part of the plug main body is received.

It may be also an aspect of the present invention to provide a plug installation structure, including: a plurality of stacked connectors, the connectors having a plurality of connectors gathering bodies where a plurality of connector parts are provided in a line; and a modular plug, the modular plug including: a plug main body that can be inserted into and removed from a connector; an engaging claw configured to engage the plug main body with the connector; and an operations lever configured to turn off engagement of the plug main body and the connector by the engaging claw; wherein the modular plug includes a lock turning-off member, the lock turning-off member is provided at the plug main body so that the lock turning-off member can be slid in inserting and removing directions; an inclination surface of the lock turning-off member is formed in a position facing the operations lever; and the inclination surface operates the operation lever accompanying sliding in the inserting direction of the lock-turning off member so that the engagement of the engaging claw and the connector is turned off.

In the plug installation, the modular plug may further include an energizing member configured to exert a force on the lock turning-off member so that the inclination surface is separated from the operations lever. In the plug installation structure, a cylindrical shape member may be provided at the plug main body; a cable connected to the plug main body is inserted inside of the cylindrical shape member; and a removing prevention part configured to prevent removal of the lock turning-off member from the plug main body is provided at the plug main body. In the plug installation structure, the inclination surface may be formed inside of a projection of the plug main body; and the projection can be used as an operations knob for operating the lock turning-off member. In the plug installation structure, the lock turning-off member may have an internal space where a part of the plug main body is received. In the plug installation structure, a position of the connector part of the connector gathering body situated at a lower step may be shifted from a position of the connector part of the connector gathering body situated at an upper step. In the plug installation structure, the connector part is a RJ-45 connector.

According to an embodiment of the present invention, the lock turning-off member is operated to be slid so that the inclination surface operates on the operations lever and engagement of the engaging claw and the connector is turned off. Therefore, in the embodiment of the present invention, unlike the related art, it is not necessary to turn off the lock of the modular plug by clamping the operations lever obliquely extended from the plug main body with fingers. Hence, even if the connectors are closely provided so that installation gaps of the modular plugs are narrowed, it is possible to securely attach or detach the modular plugs to or from the connectors. Accordingly, while the operability is kept, it is possible to realize high density installation of the modular plugs to the connectors.

In addition, when the modular plug is removed from the connector, it is necessary to slide the lock turning-off member in an insertion direction so that the modular plug is pulled out from the connector. Accordingly, it is not possible to pull out the modular plug from the connector in error. Hence, safety of the modular plug at the time of installation can be improved.

Other objects, features, and advantages of the present invention will be come more apparent from the following detailed description when read in conjunction with the accompanying drawings.

DETAILED DESCRIPTION OF THE PREFERED EMBODIMENTS

A description is given below, with reference to the FIG. 6 through FIG. 13 of embodiments of the present invention.

Figure 6:
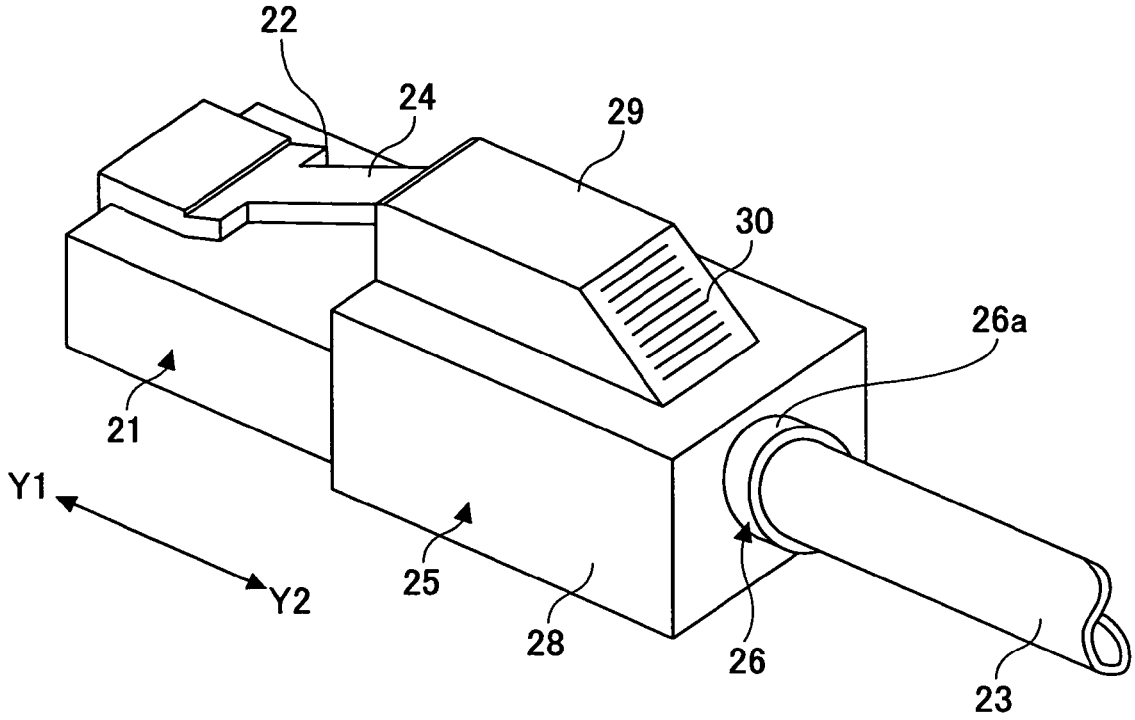
FIG. 6 is a perspective view of a plug of an embodiment of the present invention.
Figure 7:
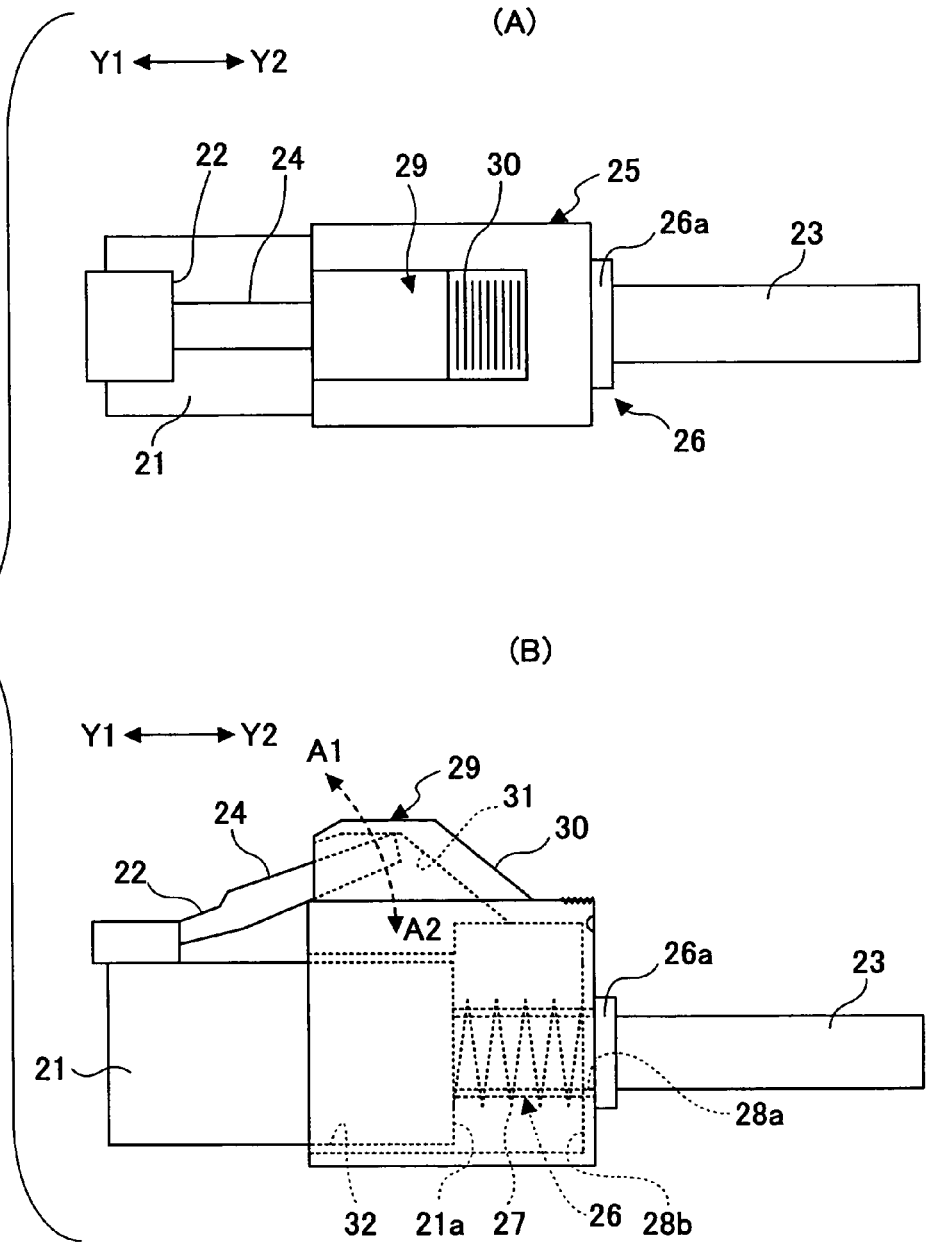
FIG. 7 is plan view and front view of the plug of the embodiment of the present invention.
Figure 8:
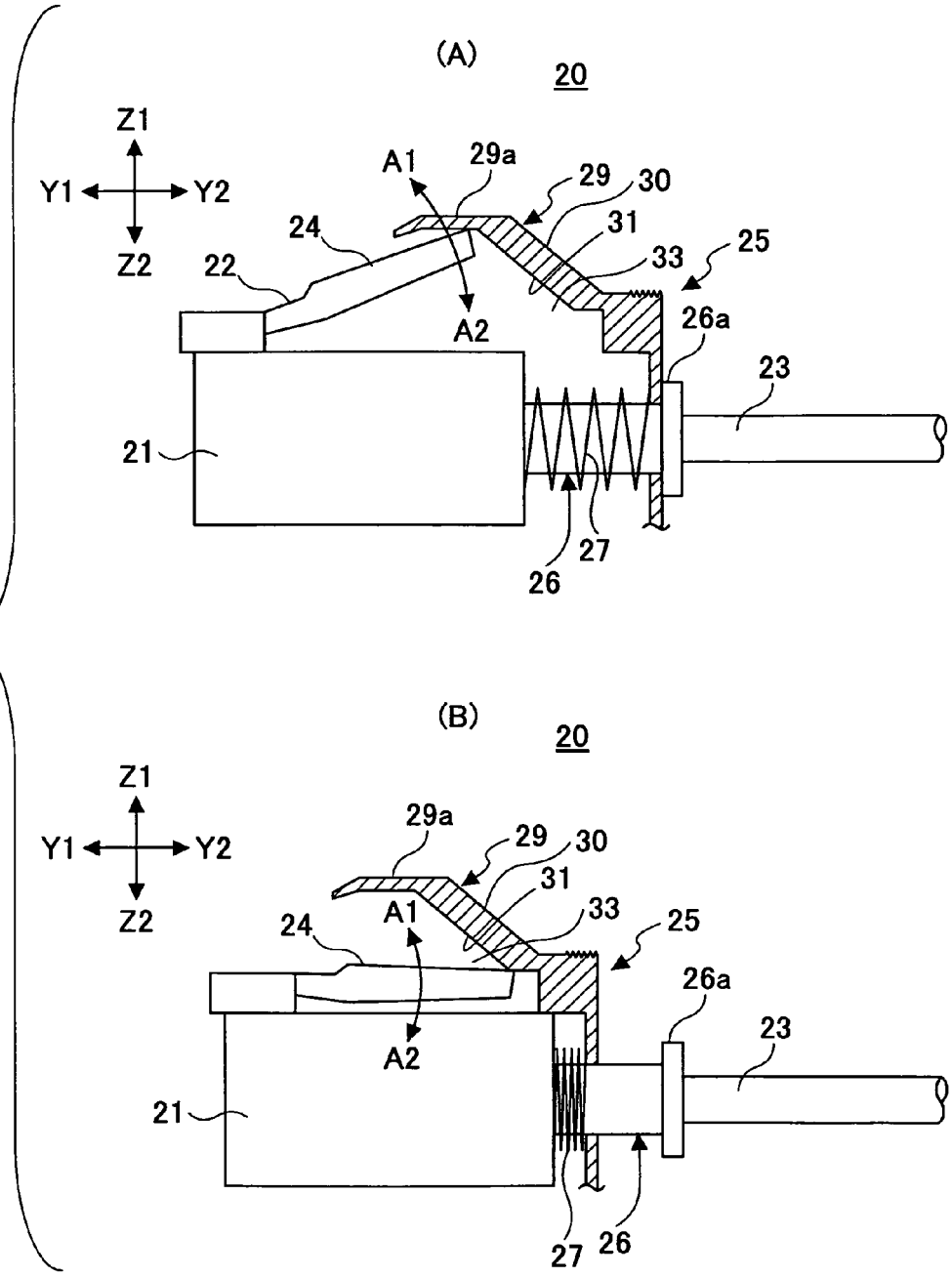
FIG. 8 is a view showing operations of the plug of the embodiment of the present invention.

FIG. 6 is a perspective view of a plug 20 of an embodiment of the present invention. FIG. 7 is plan view and front view of the plug 20 of the embodiment of the present invention. FIG. 8 is a view showing operations of the plug 20 of the embodiment of the present invention.

Parts of the connector where the plug 20 is attached or detached have the same configuration as those shown in FIG. 1 through FIG. 5 are given the same reference numbers for explanation.

The plug 20 includes a plug main body 21, a lock claw 22, a lever part 24, a lock turning-off member 25, and others. This plug 20 corresponds to the standard of RJ-45.

The plug body 21 is resin molded. A contact (not shown) electrically connected to the connector 1 is provided inside the plug body 21. In addition, a cable 23 is connected to the plug main body 21 and electrically connected to the contact pin. More specifically, a sleeve 26 which is a cylindrical shaped member is fixed to a rear surface of the plug main body 21. The cable 23 is inserted into the sleeve 26 so that the cable 23 is connected to the contact in the plug main body 21.

When the plug 20 is installed in the connector part 8 of the connector 1, the lock claw 22 is engaged with an engaging part (not shown) in the connector part 8. The lock claw 22 is engaged with the engaging part of the connector part 8 so that the plug 20 is engaged with (locked to) the connector part 8. Thus, when the plug 20 is engaged with the connector part 8 by the lock claw 22, even if an external force in a direction indicated by an arrow Y2 in FIG. 6 and where the plug 20 is pulled out is applied, it is possible to prevent the plug 20 from being removed from the connector 1. The lock claw 22 is formed in a body with the lever part 24.

The lever part 24 is formed in a body with the plug main body 21 and extends obliquely upward form the plug main body 21. The above-mentioned lock claw 22 is formed in a body in a position near the plug main body 21 of the lever part 24. The lever part 24 can be elastically moved in the directions indicated by the arrows A1 and A2 in FIG. 7(B). Accordingly the lock claw 22 formed in a body with the lever part 24 is moved accompanying the lever part 24.

The lock claw 22 is pressed to the engaging part of the connector part 8 by the elastic force of the lever part 24 so that the lock claw 22 and the engaging part of the connector part 8 are engaged. In addition, when the lever part 24 is operated in the direction indicated by the arrow A2 against an elastic energizing force, the engagement of the lock claw 22 and the engaging part of the connector part 8 is turned off (disengaged). Hence, the plug can be removed (pulled out) from the connector part 8.

Next, a structure of the lock turning-off member 25 is discussed. The lock turning-off member 25 is resin molded. The lock turning-off member 25 is formed in a body by a turning-off part main body 28, an operations projection 29, an operations part 30, an internal space 32 (See FIG. 7(B)), and others.

The internal space 32 is formed in the turning-off part main body 28. The plug main body 21 can be inserted in the internal space 32. An inserting hole 32 where the sleeve 26 is inserted is formed in the rear surface of the turning-off part main body 28. Because of this, the lock turning-off member 25 is guided by the sleeve 26 and the internal space 32 in direction indicated by arrows Y1 and Y2 where the plug 20 is inserted in or removed from the connector 1, so as to be slid along the plug main body 21.

In addition, as shown in FIG. 7(B), a coil spring 27 is provided between an external rear surface 21*a* of the plug main body 21 and an internal rear surface 28*b* of the lock turning-off member 25. The coil spring 27 exerts an elastic force so that the plug main body 21 and the lock turning-off member 25 are relatively separated. However, since a brim part 26*a* is formed at an end part of the sleeve 26 in the direction indicated by the arrow Y2, removal of the lock turning-off member 25 from the plug main body 21 is prevented by contact between the rear surface of the turning-off part main body 28 and the brim part 26*a*.

The operations projection 29 is formed on an upper surface of the turning-off part main body 28. More specifically, the operation projection 29 is formed on a surface of the turning-off main body 28 corresponding to a surface of the plug main body 21 where the lever 24 is formed. An internal space 33 is formed inside of the operations projection 29. As shown in FIG. 7(B) and FIG. 8, an inclination surface 31 is formed at an inside wall of the operations projection 29. In addition, an operations part 30 is formed at a part of the operations projection 29 in the direction indicated by the arrow Y2. The operations part 30 is operated when the plug 20 is removed (pulled out) from the connector 1.

The above-mentioned lever part 24 is positioned in the space part 33 in the operations projection 29 as shown in FIG. 7(B) and FIG. 8. Furthermore, the lever part 24 faces the inclination surface 31 formed in the operations projection 29. As discussed above, the coil spring 27 exerts the elastic force so that the plug main body 21 and the lock turning-off member 25 are relatively separated. In other words, the coil spring 27 exerts the elastic force on the lock turning-off member 25 in a direction where the inclination surface 31 is separated from the lever part 24.

As shown in FIG. 7(B) and FIG. 8(A), in a state where the lock turning-off member 25 and the brim part 26*a* come in contact with each other, namely in a state where the lock turning-off member 25 is displaced in the direction indicated by the arrow Y2, a head end part of the lever part 24 faces an upper end part of the inclination surface 31. A projection amount of the operations projection 29 having the above-discussed structure is small.

More specifically, the thickness of a top plate part 29*a* of the operations projection 29 is small while mechanical strength of the top plate part 29*a* is maintained. Because of this, the projection height of the operations projection 29 is substantially the same as (slightly higher than) the height of the lever part 24. Hence, the height in directions indicated by arrows Z1 and Z2 in FIG. 8 of the plug 20 having the operations plug 29 is not much higher than that of the related art.

Next, operations of the plug 20 are discussed with reference to FIG. 9. Here, FIG. 9 is a view showing operations whereby the plug 20 of the embodiment of the present invention is attached to or detached from the connector 1.

Figure 9:
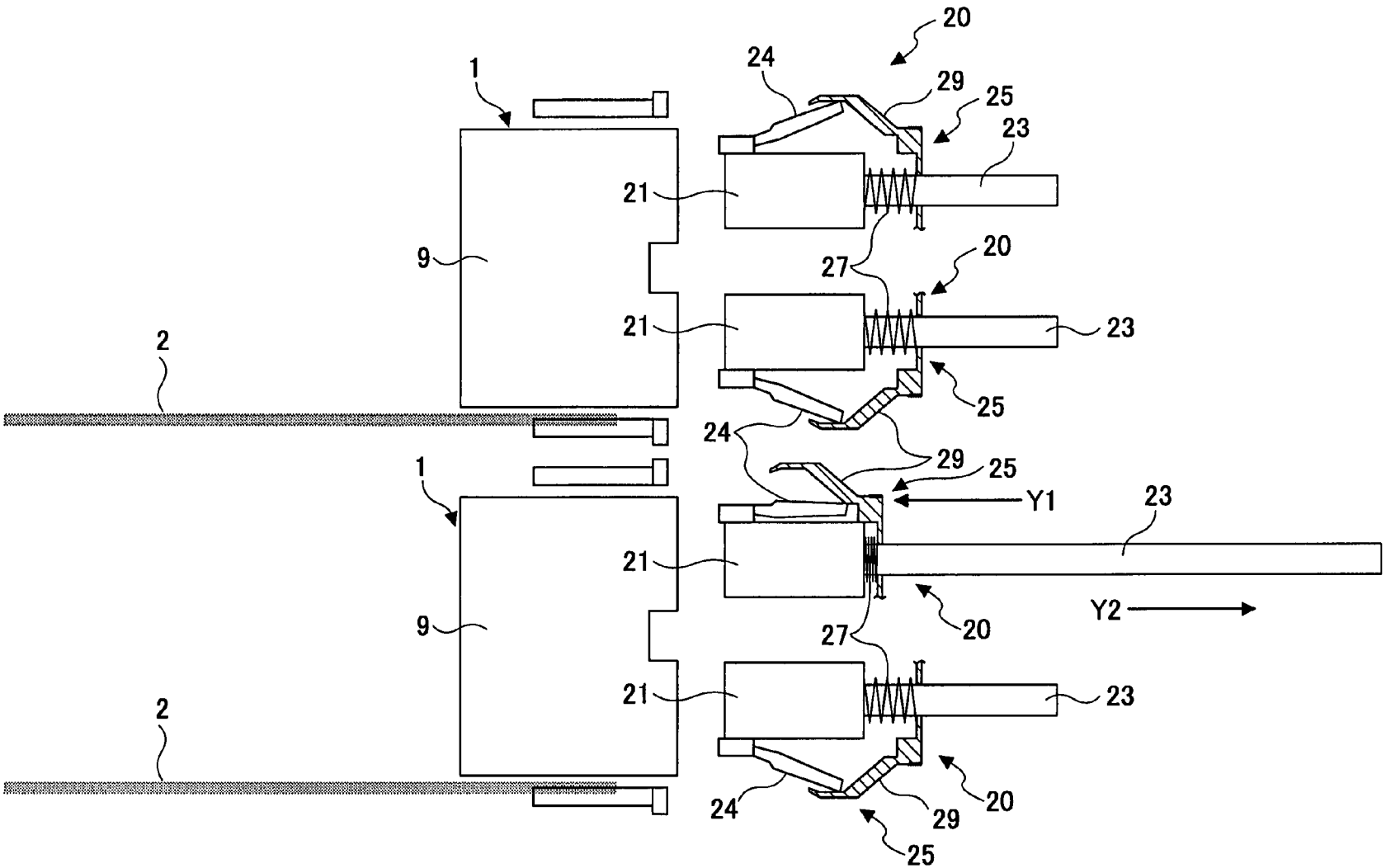
FIG. 9 is a view showing operations whereby the plug of the embodiment of the present invention is attached to or detached from a connector.

When the plug 20 is installed in the connector 1, the plug 20 is inserted in the connector part 8 of the connector 1 as shown in FIG. 9. More specifically, the lock-turning off member 25 is pressed in a direction indicated by arrow Y1 in FIG. 9.

As discussed above, the plug main body 21 and the lock turning-off member 25 are energized in a separating direction by the coil spring 27. Therefore, the plug main body 21 is moved in the direction indicated by the arrow Y1 by pressing the lock turning-off member 25 in the direction indicated by the arrow Y1 so that the plug 20 is inserted in the connector part 8. In this inserted state, the lock claw 22 is engaged with an engaging part formed in the connector part 8 so that the plug 20 is engaged with the connector 1.

Next, the operation for removing (pulling out) the plug 20 inserted in the connector 8 from the connector 8 is discussed.

In order to remove the plug 20 from the connector part 8, the operations part 30 of the lock turning-off member 25 is pressed in the direction indicated by the arrow Y1 against an elastic force of the coil spring 27.

In a state where the plug 20 is inserted in the connector 1, the plug main body 21 is engaged with (fixed to) the connector part 8. Because of this, by pressing the operations part 30 in the direction indicated by the arrow Y1, the lock turning-off member 25 is slid along the plug main body 21 in the direction indicated by the arrow Y1. At this time, in this embodiment, the operations projection 29 projecting from the plug main body 21 is used as an operations knob for operating the lock turning-off member 25. Because of this, it is possible to make the structure of the plug 20 simple as compared to a structure where the operations knob is formed separately from the operations projection 29.

On the other hand, as discussed above, since the lever part 24 is formed in a body with the plug main body 21, when the lock turning-off member 25 starts moving in the direction indicated by the arrow Y1, the inclination surface 31 formed in the operations projection 29 starts moving from the positions shown in FIG. 7(B) and FIG. 8(A) in the direction indicated by the arrow Y1 where the inclination surface 31 approaches the head end part of the lever part 24.

Accompanying the movement in the direction indicated by the arrow Y1 of the inclination surface 31 (the lock turning-off member 25), the inclination surface 31 is engaged with the head end part of the lever part 24. In addition, when the inclination surface 31 moves in the direction indicated by the arrow Y1, the lever part 24 is energized by the inclination surface 31 so as to move in the direction indicated by the arrow A2. As shown in FIG. 8(B), the lever part 24 moves in a position substantially parallel to an upper surface of the plug main body 21. Therefore, the lock claw 22 formed in a body with the lever part 24 is removed from the engaging part of the connector part 8.

As a result of this, locking (engagement) where the plug 20 is fixed to the connector 1 by the lock claw 22 is turned off. By pulling out the plug 20, the plug 20 can be removed from the connector 1. When the plug 20 is removed from the connector 1, the plug main body 21 moves in the direction indicated by the arrow Y1 along the lock turning-off member 25 due to an elastic restitution force of the coil spring 27 so that the situation goes back to that shown in FIG. 7 and FIG. 8(A).

Thus, the plug 20 can be removed from the connector 1 by simply sliding the operations part 30 (the lock turning-off member 25) in the inserting direction, namely in the direction indicated by the arrow Y1.

Figure 1:
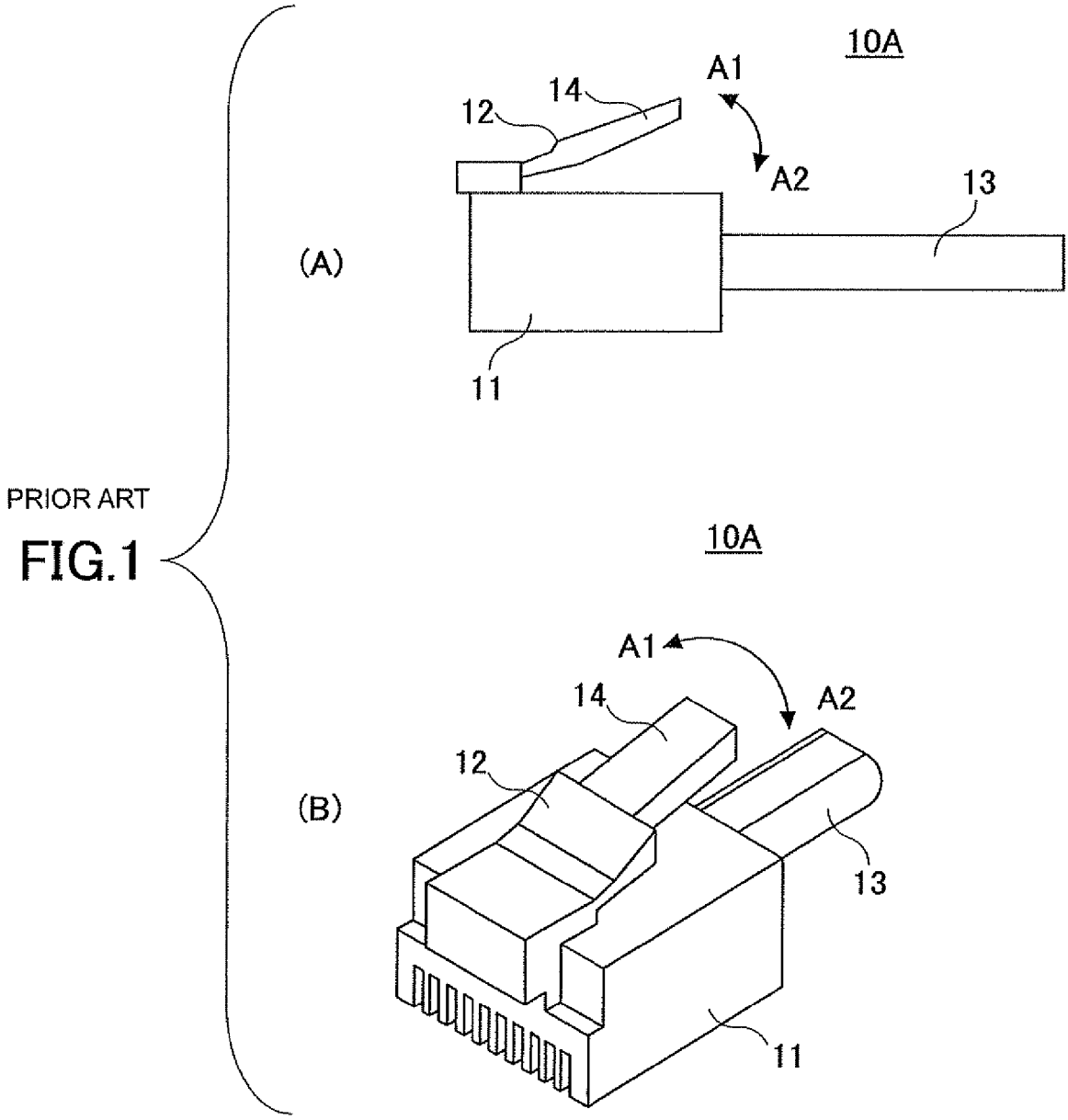
PRIOR ART FIG.1
FIG. 1 is a view showing a first related art plug.
Figure 2:
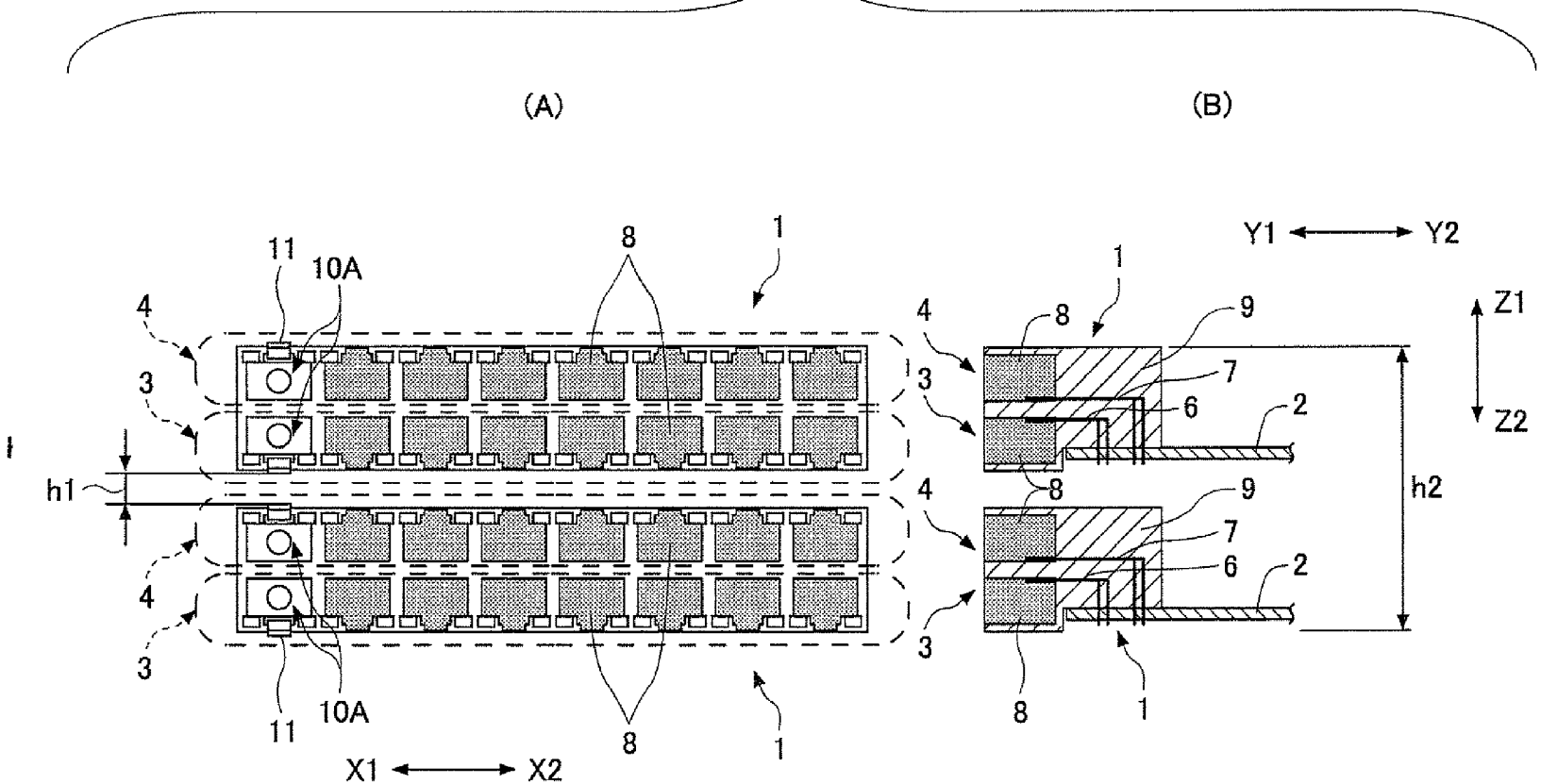
PRIOR ART FIG.2
FIG. 2 is a view showing a connector where the plug is inserted.
Figure 3:
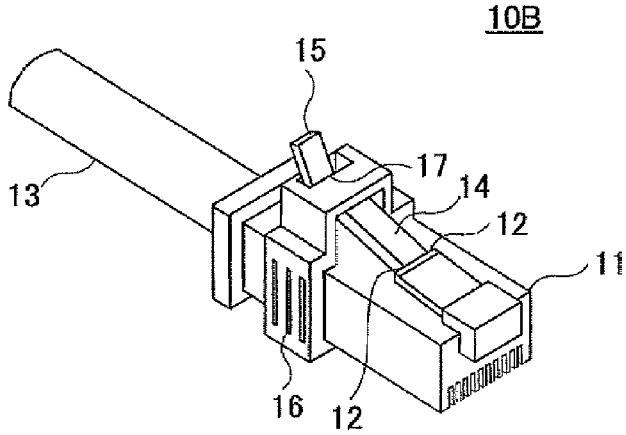
PRIOR ART FIG.3
FIG. 3 is a view showing a second related art plug.
Figure 4:
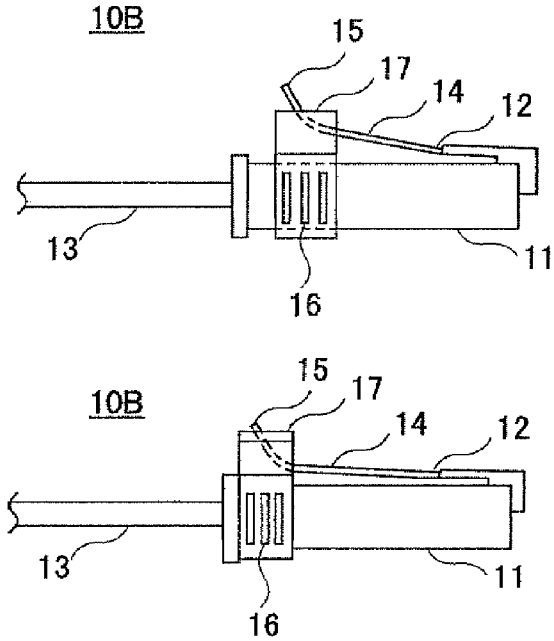
PRIOR ART FIG.4
FIG. 4 is a view showing operations of the second related art plug.
Figure 5:
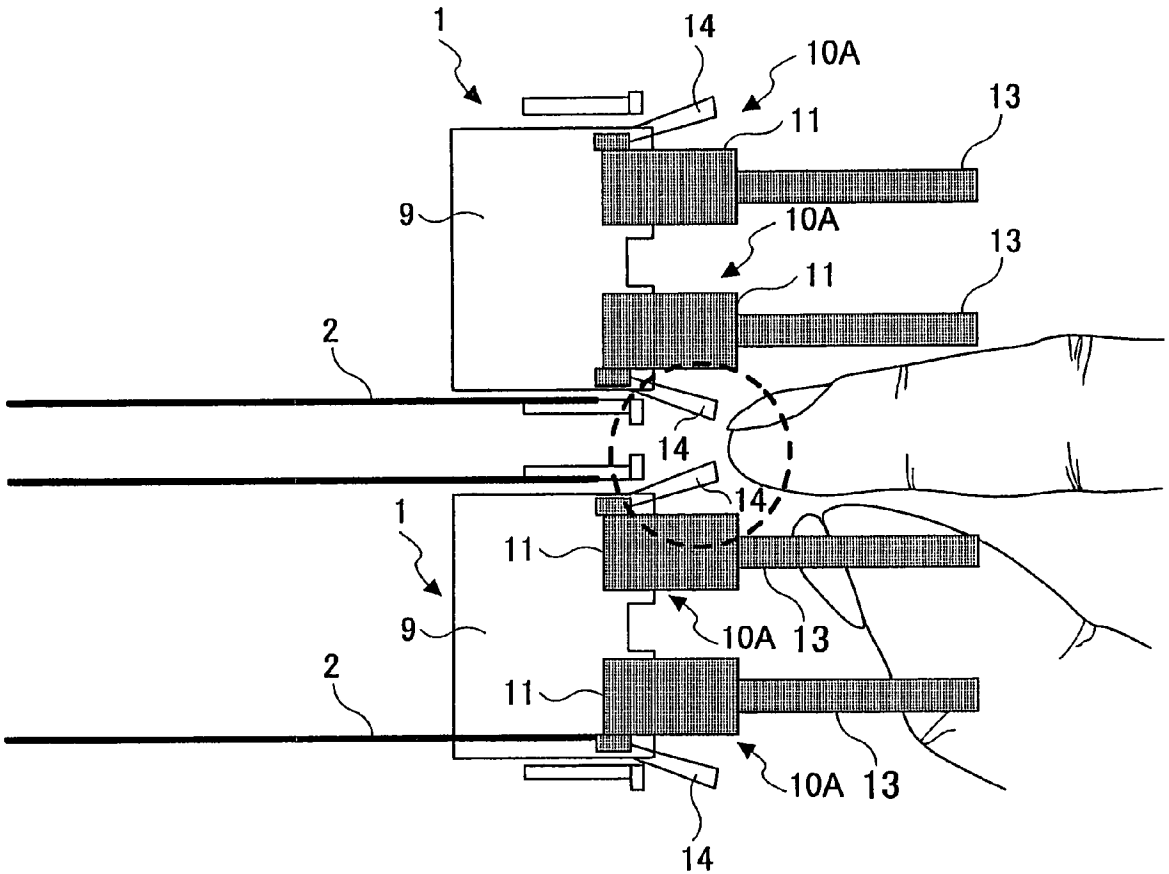
PRIOR ART FIG.5
FIG. 5 is a view showing a disadvantage of the first related art plug.

Accordingly, unlike the related art plug 10A shown in FIG. 1, it is not necessary to clamp the plug main body 11 and the lever part 14 by fingers in upper and lower directions at the time of removal and move the lever part 14 in the direction indicated by the arrow A2. Furthermore, unlike the related art plug 10B shown in FIG. 3 and FIG. 4, it is not necessary to clamp the movable part 16 by fingers in left and right directions at the time of removal and move it.

Thus, in this embodiment, even if the connector parts 8 are closely situated in the connector 1 so that installation gaps of the plugs 20 are made narrow, it is possible to securely attach or detach the plug 20 to or from the connector 1. Therefore, while the operability of the plug 20 is maintained, it is possible to realize high density installation of the plugs 20 or the connector parts 8.

In addition, in order to remove the plug 20 from the connector 1, it is necessary to slide the lock turning-off member 20 in the insertion direction, namely the direction indicated by the arrow Y1, and then to pull the plug 20 out from the connector 1 in the removal direction, namely the direction indicated by the arrow Y2. Thus, since the plug 20 can be removed from the connector 1 by operations in two directions, it is possible to prevent the plug 20 being accidentally removed from the connector 1 in error.

Figure 10:
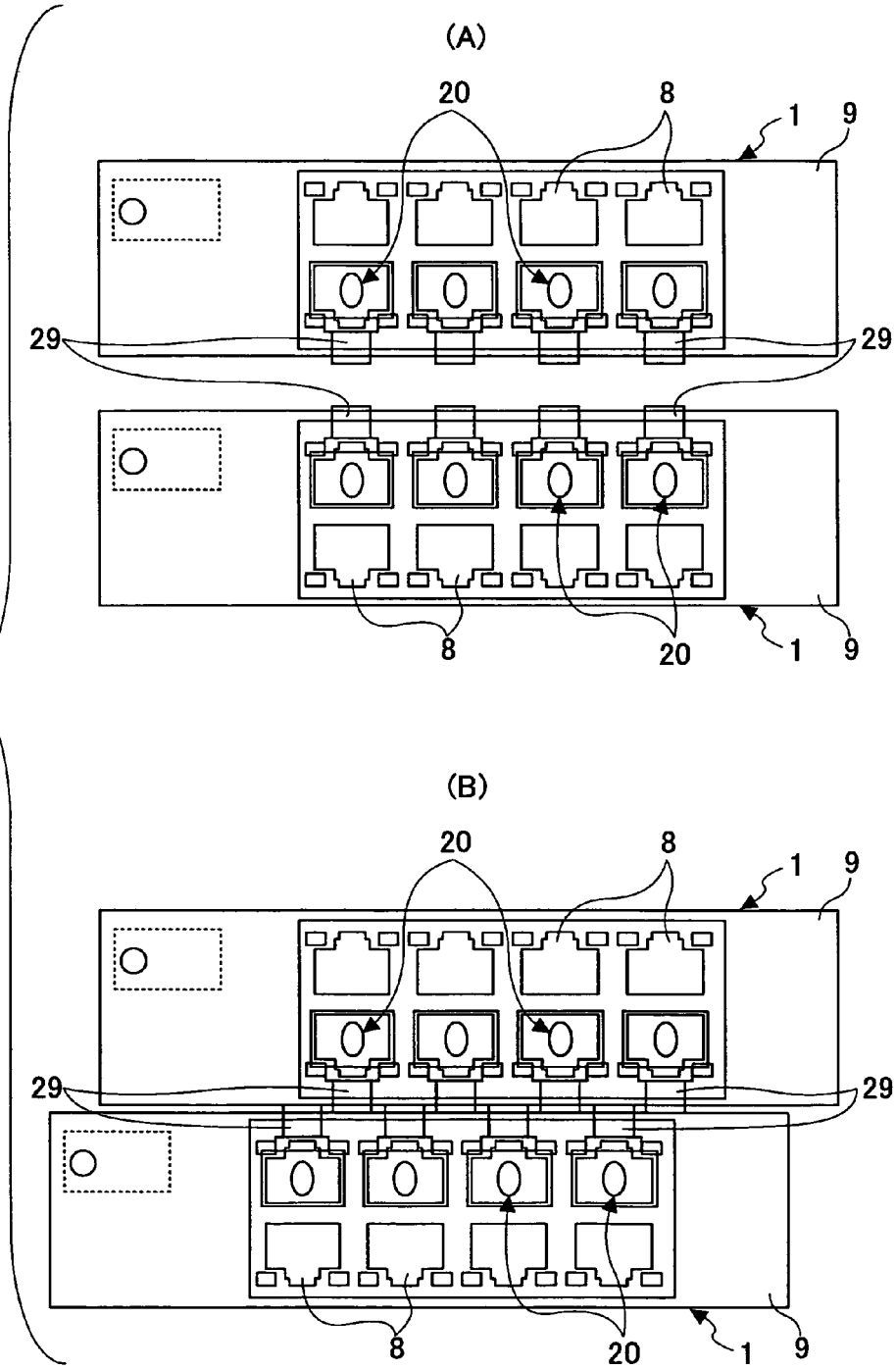
FIG. 10 is a view seen from an opening side of a connector part of the connector where the plug of the embodiment of the present invention is installed.

FIG. 10 is a front view seen from an opening side of the connector part 8 of the connector 1 where the plug 20 of the embodiment of the present invention is inserted.

FIG. 10(A) shows a structure where a pair of upper and lower connectors 1 is stacked. The connector parts 8 of the pair of upper and lower connectors 1 are closely situated. However, in the plug 20 of the embodiment of the present invention, it is sufficient to make gaps where the operations projection 29 can be pressed and it is not necessary to form a space for the finger of the operator. Therefore, it is possible to provide the upper and lower connector parts 8 at a close interval. In addition, as shown in FIG. 10(B), by providing the connector parts 8 with a half pitch shift between the upper and lower connectors 1, it is possible to further narrow the gap between the upper and lower connectors 1 and make the connector 1 small and thin.

Figure 11:
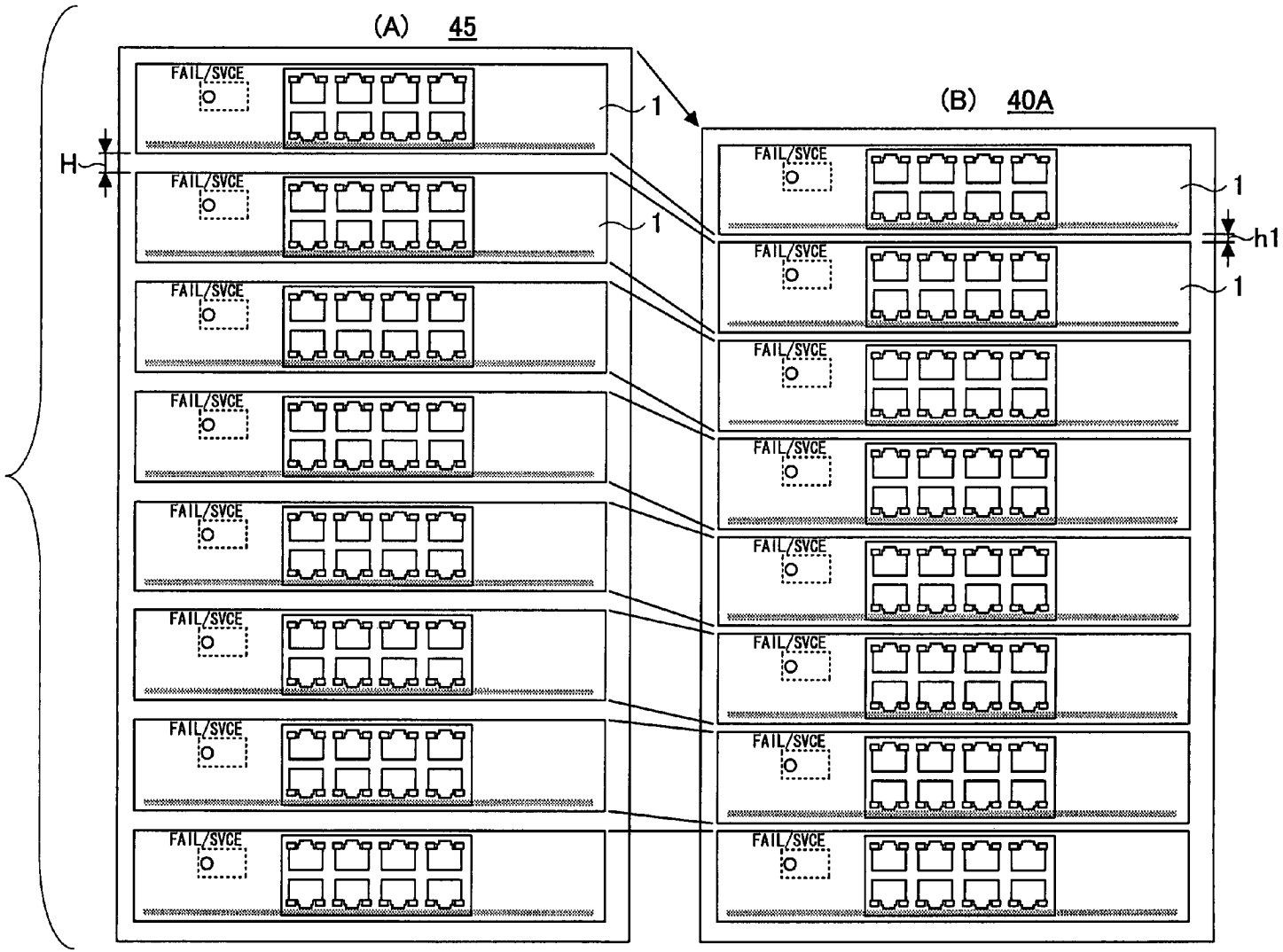
FIG. 11 is a first view showing that the size of the connector can be made small by applying the plug of the embodiment of the present invention, with comparison to the related art.
Figure 12:
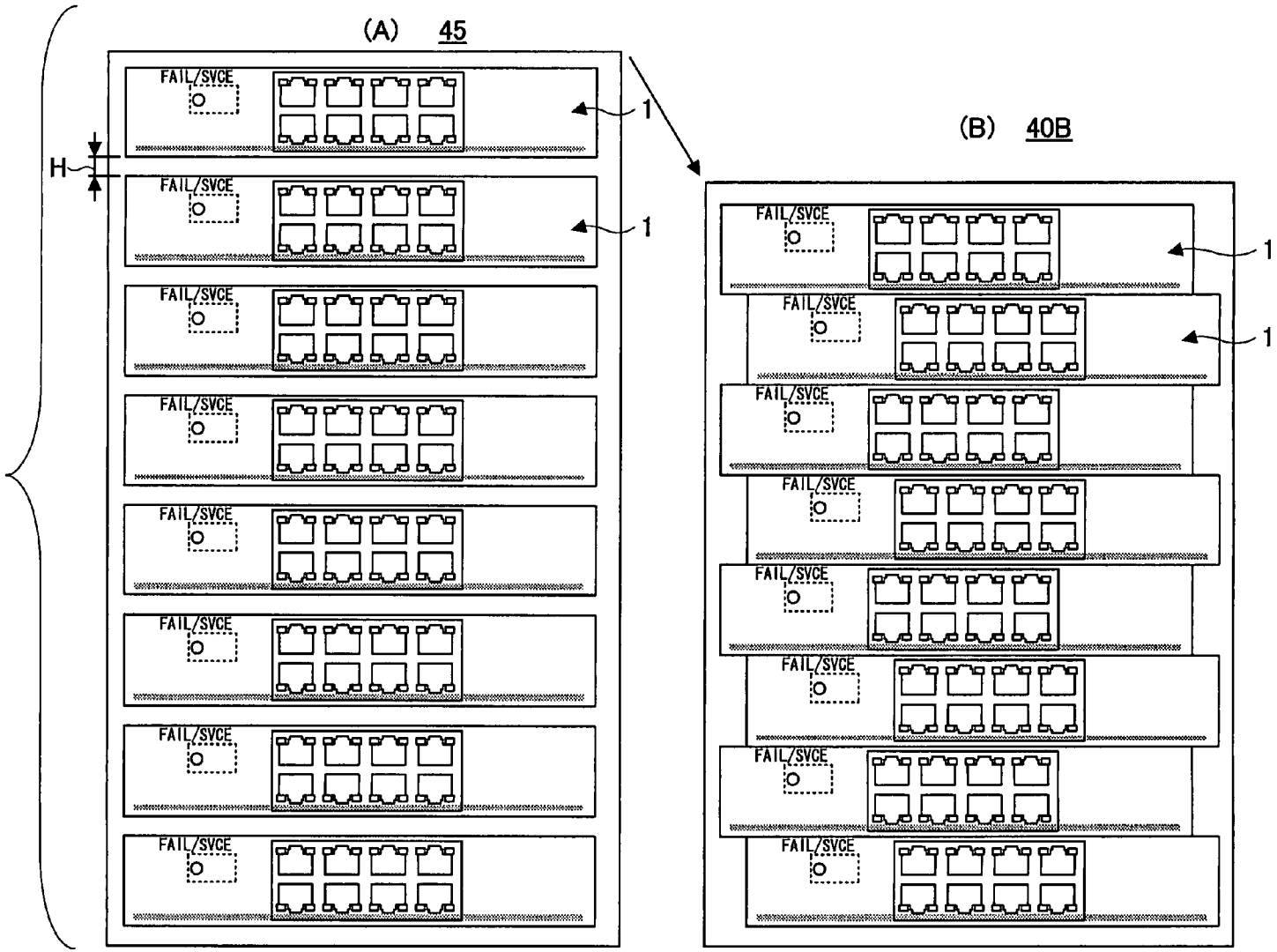
FIG. 12 is a second view showing that the size of the connector can be made small by applying the plug of the embodiment of the present invention, with comparison to the related art.
Figure 13:
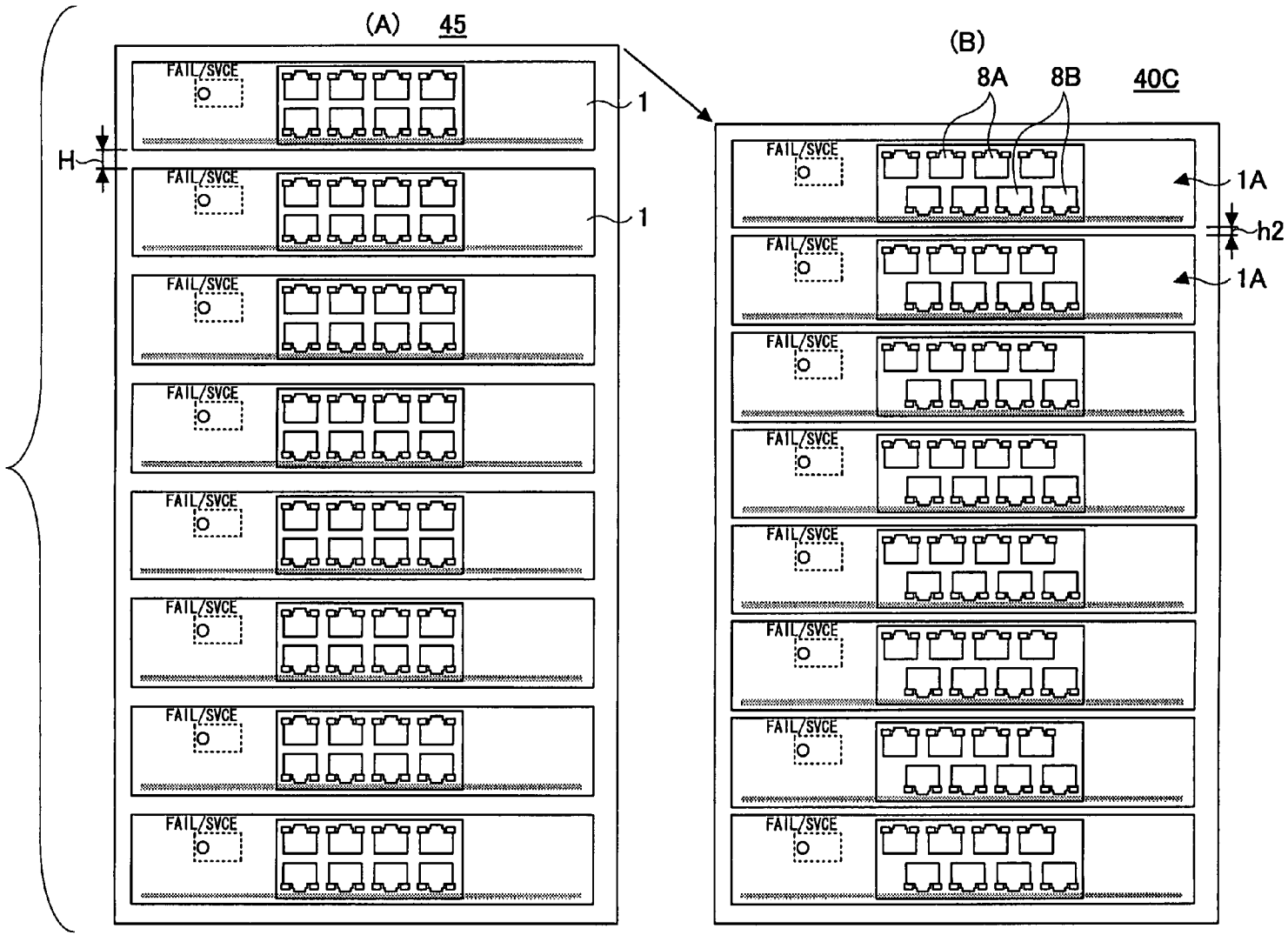
FIG. 13 is a third view showing that the size of the connector can be made small by applying the plug of the embodiment of the present invention, with comparison to the related art.

FIG. 11 through FIG. 13 are first through third views showing that the size of the connector 1 can be made small by applying the plug 20 of the embodiment of the present invention, with comparison to the related art. In FIG. 11 through FIG. 13, (A) shows a plug-in unit 45 corresponding to the related art plug 10A and (B) shows plug-in units 40A through 40C corresponding to the plug 20 of the embodiment of the present invention.

FIG. 11(B) shows the plug-in unit 40A where the upper and lower connectors 1 are stacked so that the upper and lower connector parts 8 face each other. In this case, although the distance indicated by the arrow H is necessary for separation of the upper and lower connectors 1 in the related art, it is possible to make it less as indicated by an arrow h1 by making the structure corresponding to the plug 20.

FIG. 12(B) shows the plug-in unit 40B where the upper and lower connectors 1 are stacked by shifting the upper and lower connectors 1 in right and left directions so that the upper and lower connector parts 8 are shifted in right and left directions. In this structure, it is possible to eliminate the separation of the upper and lower connectors 1.

FIG. 13(B) shows the plug-in unit 40C where the connectors 1A are stacked. The connector 1A has a structure where the connector parts 8A provided at an upper part in a line and the connector parts 8B provided at a lower part in a line are shifted at a half pitch. In this case, although the distance indicated by the arrow H is necessary for separation of the upper and lower connectors 1 in the related art, it is possible to make the separation distance between the connector part 8B of the upper connector 1A and the connector part 8B of the lower connector 1A less as indicated by an arrow h2 by the plug-in unit 40C.

Thus, by using the plug 20 of the embodiments of the present invention, it is possible to miniaturize the plug-in units 40A, 40B and 40C.

The present invention is not limited to these embodiments, but variations and modifications may be made without departing from the scope of the present invention.

This patent application is based on Japanese Priority Patent Application No. 2006-144291 filed on May 24, 2006, the entire contents of which are hereby incorporated by reference.

What is claimed is:

1. A modular plug, comprising:

a plug main body that can be inserted into and removed from a connector;

an engaging claw configured to engage the plug main body with the connector; and an operations lever configured to turn off engagement of the plug main body and the connector by the engaging claw;

wherein a lock turning-off member is movably coupled to the plug main body so that the lock turning-off member can be freely slid relatively thereto in inserting and removing directions;

an inclination surface of the lock turning-off member is formed in a position facing the operations lever; and the inclination surface operates the operation lever accompanying the sliding, in the inserting direction, of the lock-turning off member so that the engagement of the engaging claw and the connector is turned off.

2. The modular plug as claimed in claim 1, further comprising:

an energizing member configured to exert a force on the lock turning-off member so that the inclination surface is separated from the operations lever.

3. The modular plug as claimed in claim 1, wherein a cylindrical shape member is provided at the plug main body;

a cable connected to the plug main body is inserted inside of the cylindrical shape member; and a removing prevention part configured to prevent removal of the lock turning-off member from the plug main body is provided at the plug main body.

4. The modular plug as claimed in claim 1, wherein the inclination surface is formed inside of a projection of the lock turning-off member; and the projection is operable as an operations knob for operating the lock turning-off member.

5. The modular plug as claimed in claim 1, wherein the lock turning-off member has an internal space where a part of the plug main body is received.

6. A plug installation structure, comprising:

a plurality of stacked connectors, the connectors having a plurality of connectors gathering bodies where a plurality of connector parts are provided in a line; and a modular plug, the modular plug including:

a plug main body that can be inserted into and removed from a connector;

an engaging claw configured to engage the plug main body with the connector; and an operations lever configured to turn off engagement of the plug main body and the connector by the engaging claw;

wherein the modular plug includes a lock turning-off member, the lock turning-off member is movably coupled to the plug main body so that the lock turning-off member can be freely slid relatively thereto in inserting and removing directions;

an inclination surface of the lock turning-off member is formed in a position facing the operations lever; and the inclination surface operates the operation lever accompanying the sliding, in the inserting direction, of the lock-turning off member so that the engagement of the engaging claw and the connector is turned off.

7. The plug installation structure as claimed in claim 6, wherein the modular plug further includes an energizing member configured to exert a force on the lock turning-off member so that the inclination surface is separated from the operations lever.

8. The plug installation structure as claimed in claim 6, wherein a cylindrical shape member is provided at the plug main body;

a cable connected to the plug main body is inserted inside of the cylindrical shape member; and a removing prevention part configured to prevent removal of the lock turning-off member from the plug main body is provided at the plug main body.

9. The plug installation structure as claimed in claim 6, wherein the inclination surface is formed inside of a projection of the lock turning-off member; and the projection is operable as an operations knob for operating the lock turning-off member.

10. The plug installation structure as claimed in claim 6, wherein the lock turning-off member has an internal space where a part of the plug main body is received.

11. The plug installation structure as claimed in claim 6, wherein a position of the connector part of the connector gathering body situated at a lower step is shifted from a position of the connector part of the connector gathering body situated at an upper step.

12. The plug installation structure as claimed in claim 6, wherein the connector part is an RJ-45 connector.

* * * * *